United States Patent [19]

Freidank et al.

[11] Patent Number: 4,873,970

[45] Date of Patent: Oct. 17, 1989

[54] WARNING DEVICE TO INDICATE THE STATE OF GASES EXHAUSTION OF A GAS FILTER RETAINING DANGEROUS GASES

[75] Inventors: Michael Freidank; Jurgen Coym; Axel Schubert, all of Berlin, Fed. Rep. of Germany

[73] Assignee: Auergesellschaft GmbH, Berlin, Fed. Rep. of Germany

[21] Appl. No.: 323,069

[22] Filed: Mar. 10, 1989

Related U.S. Application Data

[63] Continuation of Ser. No. 41,595, Apr. 22, 1987, abandoned.

[30] Foreign Application Priority Data

Apr. 22, 1986 [DE] Fed. Rep. of Germany ..... 3613512

[51] Int. Cl.[4] ..... A62B 7/10

[52] U.S. Cl. ..... 128/202.22; 128/204.15; 128/205.27; 128/206.12; 128/207.12

[58] Field of Search ..... 128/202.22, 204.15, 128/205.27, 205.29, 206.12, 206.15, 206.17, 206.21, 207.12

[56] References Cited

U.S. PATENT DOCUMENTS 1,320,935 11/1919 Schwartz ..... 128/206.15 X 3,902,485 9/1975 Wallace ..... 128/205.27

*Primary Examiner*—Alan Cohan

*Attorney, Agent, or Firm*—Reed Smith Shaw & McClay

[57] ABSTRACT

A warning device comprised of an electrochemical cell which detects the concentration of toxic gas that is passing through a housing holding the cell to a face mask. The cell produces a signal corresponding to the concentration level of toxic gas present. The signal is received by a threshold switch which is set to produce a signal only when a signal from the cell equals or exceeds a predetermined level. The signal from the threshold switch activates a visual signal means and acoustical signal means to indicate that a gas filter, connected to the warning device, is exhausted.

12 Claims, 3 Drawing Sheets

WARNING DEVICE TO INDICATE THE STATE OF GASES EXHAUSTION OF A GAS FILTER RETAINING DANGEROUS GASES

This is a continuation of co-pending application Ser. No. 07/041,595 filed on Apr. 22, 1987 now abandoned.

FIELD OF THE INVENTION

The present invention relates to a warning device that indicates the state of exhaustion of a gas filter retaining dangerous gases. More specifically, the present invention relates to an electrochemical warning device that indicates the state of exhaustion of a gas filter which removes and retains from the air dangerous gases or converts them to less dangerous substances.

BACKGROUND OF THE INVENTION

Whenever a gas filter is used to remove or retain dangerous gases, it is important to be able to identify when the filter is exhausted and needs to be replaced. For a filter to be exhausted before being replaced would allow for maximal use of the filter but may be extremely harmful to a person who must rely on the filter for safe breathable air. By providing some indication that the filter is nearly at the end of its life, it assures the safety of a person relying upon it, but very often causes a filter to be replaced prematurely, thus contributing to added maintenance expense of a filter-breathing device.

In the case of a known warning device of this type, the nearing end of the useful life of the gas filter is indicated to the user by means of a chemical warning layer in the gas filter in such a way that an unpleasant smell is noticed by the user on the clean air side of the gas filter. This is the so-called "smell warning."

This warning device has a disadvantage, since the effect of humidity on the warning layer may incorrectly indicate prematurely the exhaustion of the gas filter retaining the dangerous gases, with the result that the gas filter is not optimally used.

SUMMARY OF THE INVENTION

Accordingly, one object of the present invention is to provide a warning device that indicates the state of exhaustion of a gas filter retaining dangerous gases which assures a positive indication of the state of exhaustion with optimal utilization of the useful life of the gas filter.

Another object of the present invention is to provide an electrochemical warning device that is activated after a predetermined concentration threshold of dangerous gases is passed.

These and other objects of the present invention are accomplished with a warning device for the detection of a toxic gas comprising: a housing having an inlet and an outlet through which gas is able to enter and leave the housing; electrochemical means for detecting the concentration of the toxic gas that enters the housing, said electrochemical means disposed within the housing; means for alerting disposed on the housing; and means for activating the alerting means when a predetermined concentration of toxic gas is detected, said activation means disposed within said housing.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
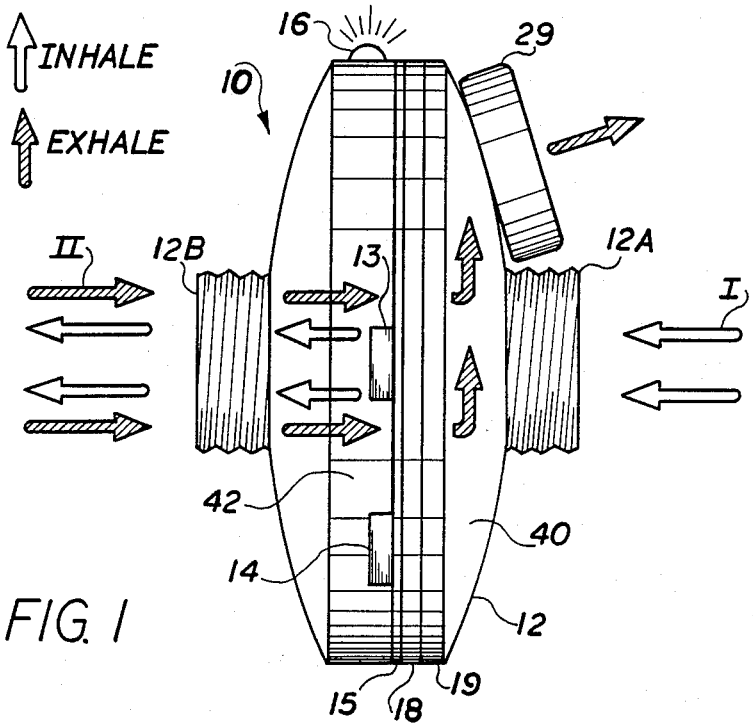
FIG. 1 is a lateral view of the housing holding the warning device, sectional in part.
Figure 2:
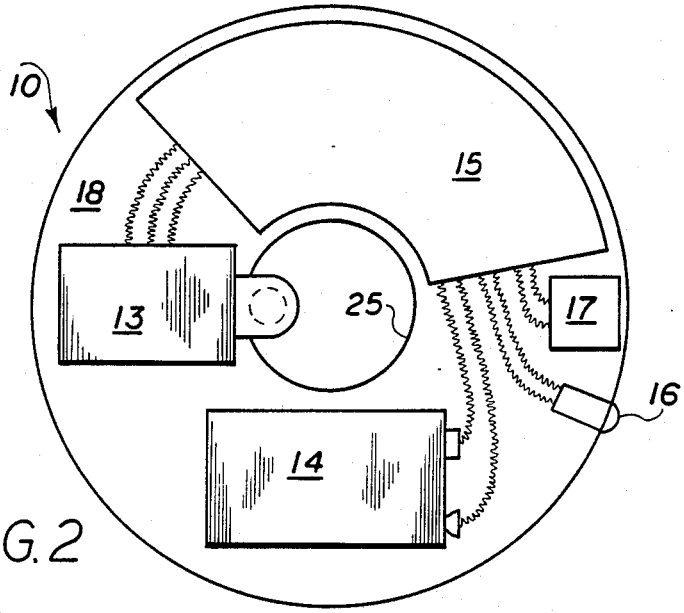
FIG. 2 is a top view of the housing with warning device, cover of housing removed.

Referring now to the drawings, wherein like reference numerals designate identical or corresponding parts throughout the several views, and more particularly to FIG. 1 and FIG. 2 thereof, there is shown a warning device 10 comprised of a cartridge-like housing 12 with two opposite connecting pipe sockets **12*a* and 12*b*, in which are arranged an electrochemical measuring cell 13, a battery 14, an electronic circuit 15, a light emitting diode 16, an acoustical signal generator 17, a backing board 18 and a heat exchanger 19. The backing board 18 is arranged in the housing 12 to divide the housing into an inlet chamber 40 and an outlet chamber 42. The backing board 18 supports the cell 13, battery 14, electronic circuit 15 and acoustical signal generator, all of which are preferably located in the outlet chamber. If the heat exchanger is used it is arranged alongside the backing board 18. All gas passing through the pipe socket or inlet 12*a* must pass through the heat exchanger 19 before it reaches the cell 13. The backing board has a hole 25 which allows gas to pass between the inlet chamber 40 and the outlet chamber 42. A breathe-out valve 29 is located adjacent to the inlet chamber 40. The breathe-out valve 29 allows gas that is exhaled back through the pipe socket or housing outlet 12*b* to be expelled from the housing without the exhaled gas being able to pass through the inlet 12*a*. The breathe-out valve 29 allows gas to enter into the housing 12 via the inlet 40 from a gas filter, but the breathe-out valve 29 draws shut so external gas cannot enter through it when a suction, for instance from inhalation, is placed on the housing, as is well known in the art. The heat exchanger 19 is only required if the warning device is used, for example, with a carbon monoxide gas filter, since in this case the inhaled air can be expected to reach temperatures over 35° C., and the electrochemical measuring cell 13 has to be protected from such hot temperatures. When a heat exchanger 19 is used, the warning device 10 must be exposed to inhalation and exhalation so that the breathe-out valve must be closed. In cases where the inhalation temperature is below 35° C., no heat exchanger is required in the warning device 10. As a consequence, the warning device 10 may or may not need a breathe-out valve 29. If it is so desired that exhaled breath not enter a gas filter than the breathe-out valve 29 may be present and open. There currently exist electrochemical measuring cells for the detection of carbon monoxide, chlorine, hydrogen sulfide, hydrogen cyanide and oxygen which can be inserted into the warning device 10** for the respective gas filters.

Figure 3:
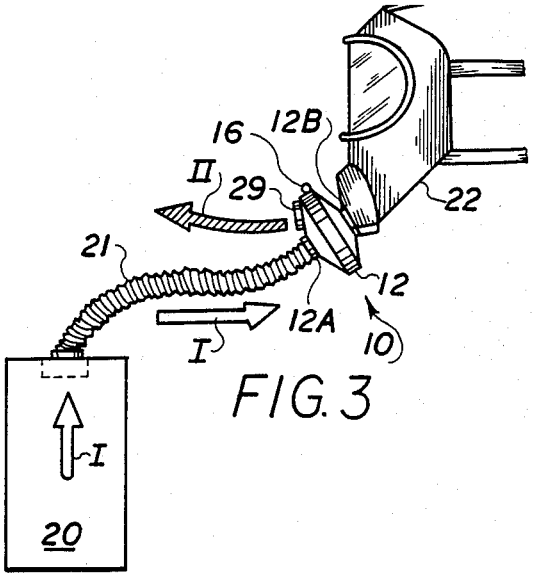
FIG. 3 is an example of a filter unit, where the warning device is connected directly to the full mask and connected via a breathing hose with a filter cartridge.
Figure 4:
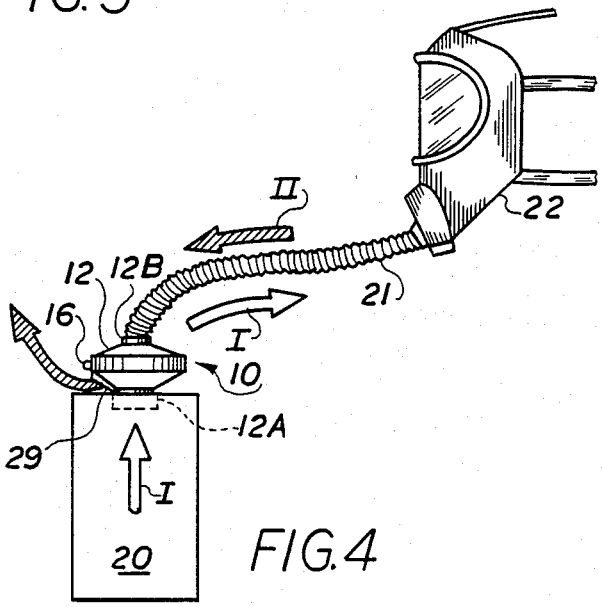
FIG. 4 is an example of a filter unit, where the warning device is connected directly with the filter cartridge, and connected via the breathing hose with the full mask.
Figure 5:
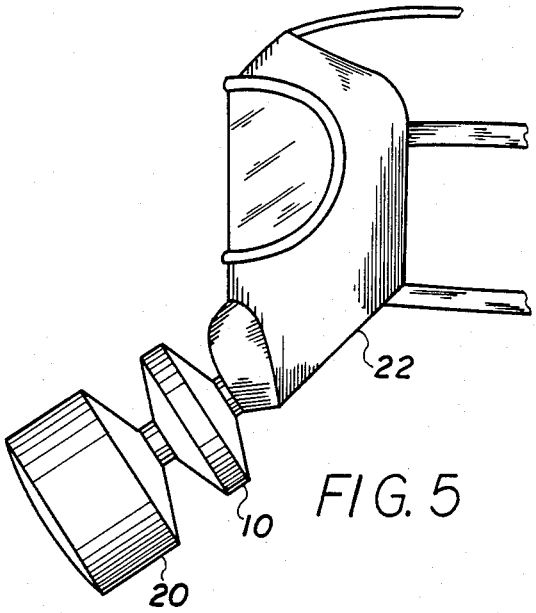
FIG. 5 is an example of the filter unit, where the warning device is arranged between a gas filter and the full mask.

FIGS. 3 to 5 show how the warning device 10 can be installed in a filter unit. In FIG. 3 the cartridge-like housing 12 of the warning device 10 is connected—on one side—with the inlet 12*a* to a breathing hose 21 leading to a gas filter 20, and—on the other side—it is connected with the outlet 12*b* directly to a full mask 22. The gas filter 20 could also be a filter cartridge.

In the operation of the invention, the warning device 10 thus installed in a filter unit, for instance a gas filter retaining carbon monoxide, is as follows. Breath goes through the gas filter 20 in one direction, i.e. the inhaled air I flows through the gas filter 20 and through the warning device 10 into the full mask 22 of a user. The exhaled air II then passes through the warning device 10 to a point behind the heat exchanger 19 and flows off via the breathe-out valve 29. This makes it clear that the warning device 10 is exposed to reciprocating breathing. The heat exchanger 19 is cooled by the exhaled air II, so that—when breathing in again—the hot inhaled air I from the gas filter 20 is cooled, preferably to below 40° C., in order to assure perfect functioning of the electrochemical measuring cell 13. The inhaled air reaches via a bypass (not shown in the drawing), by diffusion through a teflon membrane, the interior of the measuring cell 13.

The measuring cell works according to the principle of electrochemical oxidation and serves as the measuring element for the detection of dangerous gas concentrations in the inhaled air which cannot be retained or removed by the gas filter 20 in case of a state of exhaustion. In other words: the measuring cell 13 measures a certain dangerous concentration, which indicates that the dangerous or toxic material retained in the gas filter is breaking through, which means that the gas filter 20 is exhausted.

In FIG. 4 the warning device 10 with the inlet 12*a* is directly connected with the gas filter 20 which has the design of a filter cartridge. The warning device is connected via the outlet 12*b* to the breathing hose 21 with the full mask 22.

In FIG. 5 the warning device 10 is installed between the gas filter 20 and the full mask 22.

Figure 6:
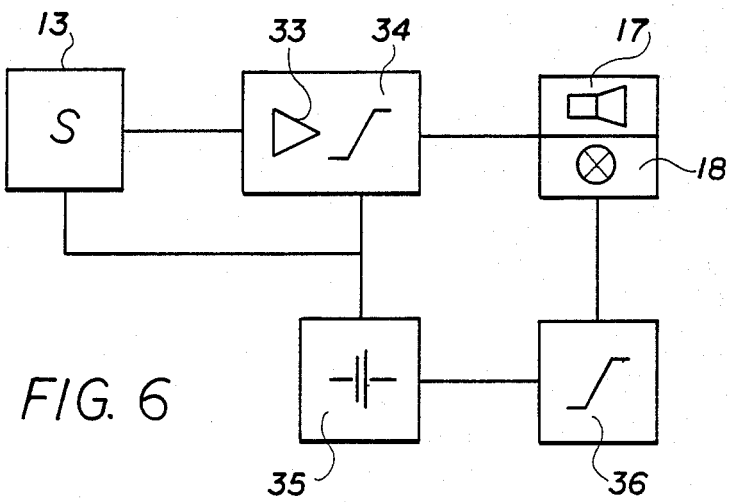
FIG. 6 is a circuit diagram of the warning device.

FIG. 6 shows the circuit diagram of the electronic circuit of the warning device 10. The circuit is comprised of the electrochemical measuring cell 13, a signal amplifier 33, a threshold value switch 34, the light emitting diode 16 and the acoustical signal generator 17. A battery 35 is provided to supply energy to the circuit, with a battery monitor 36 which indicates the consumption/depletion of the battery optically and acoustically at the light emitting diode 16 and at the signal generator 17.

The switching threshold of the threshold value switch 34 is adjusted to the measuring signal which corresponds to a predetermined level of toxic gas present in the inhaled air. This corresponds to a certain dangerous gas concentration which indicates the end of the useful life of the gas filter 20. If for instance the measuring signal coming from the measuring cell 13 exceeds the set switching threshold (alarm threshold) of the threshold value switch 34, the output of the threshold value switch 34 will carry a current which activates the light emitting diode 16 and the signal generator 17, and the optical and acoustical alarm is released. The gas filter 20 is then exhausted.

According to the invention, this problem is solved by the characteristics of the warning device 10. As can be seen from the above explanation, the advantages achieved with the invention are in particular the fact that the period of use of the gas filter can be substantially extended as compared to other methods used so far. Additionally, a positive indication of the state of exhaustion is possible.

Obviously, numerous (additional) modifications and variations of the present invention are possible in light of the above teachings. It is therefore to be understood that within the scope of the appended claims, the invention may be practiced otherwise than as specifically described herein.

We claim:

1. A warning device for indicating the exhaustion of a separate gas filter retaining a toxic gas which device functions independently from the gas filter and comprises:

a housing having an inlet and an outlet through which gas is able to enter and leave the housing;

electrochemical means for directly detecting the overall concentration of the toxic gas that enters the housing from the gas filter, said electrochemical means disposed within the housing;

means for alerting disposed on the housing; and means for activating the alerting means when a predetermined concentration of toxic gas is detected, said activation means disposed within said housing.

2. A warning device as described in claim 1 wherein the electrochemical means is an electrochemical measuring cell that produces a signal corresponding to the detected concentration of toxic gas that has entered the housing.

3. A warning device as described in claim 2 wherein the activating means is comprised of a threshold switch which produces a signal that activates the alerting means when the signal produced by the cell corresponds to a predesired concentration.

4. A warning device as described in claim 3 wherein the alerting means includes a visual signal means and an acoustical signal means that is activated when a signal is produced by the threshold switch, said acoustical signal means disposed within the housing, said visual signal means disposed on said housing, said visual signal means and said acoustical signal means electrically connected to said threshold switch in order to receive the signal produced from said threshold switch.

5. A warning device as described by claim 4 including a battery disposed inside the housing and connected to the switch and the cell in order to power them.

6. A warning device as described in claim 5 including a breathe-out valve located in and through the housing alongside the inlet so any gas returning into the housing through the outlet is expelled through the breathe-out valve and is not able to pass back through the housing inlet, said breathe-out valve allowing gas to pass into the housing through the housing inlet.

7. A warning device as described in claim 5 including a gas filter fluidically connected to the housing inlet and a full face mask fluidically connected to the housing outlet and wherein said threshold switch is set to produce a signal when the concentration of toxic gas detected by the cell indicates the end of the useful life of the gas filter.

8. A warning device for the detection of a toxic gas comprising:

a housing having an inlet and an outlet through which gas is able to enter and leave the housing, the housing having an inlet chamber and an outlet chamber;

a heat exchanger arranged in the housing to divide the housing into the inlet chamber and the outlet chamber;

a backing board arranged in the outlet chamber and alongside the heat exchanger, said backing board having a hole which allows gas to pass between the inlet chamber and outlet chamber;

an electrochemical measuring cell that produces a signal corresponding to the detected concentration of toxic gas that has entered the housing, said electrochemical measuring cell disposed within the housing in the outlet chamber and attached to and supported in place by the backing board;

a threshold switch which produces a signal when the signal produced by the cell corresponds to a predesired concentration, said threshold switch located in the outlet chamber and attached to and supported in place by the backing board;

a visual signal means and an acoustical signal means that are activated when a signal is produced by the threshold switch, said acoustical signal means disposed within the housing in the outlet chamber and attached to and supported in place by the backing board, said visual signal means disposed on said housing, said visual signal means and said acoustical signal means electrically connected to said threshold switch in order to receive the signal produced from said threshold switch;

a battery disposed inside the housing in the outlet chamber and attached to and supported in place by the backing board, said battery connected to the switch and the cell in order to power them;

a breathe-out valve disposed in and through the inlet chamber of the housing alongside the inlet so any gas returning into the housing through the outlet is expelled through the breathe-out valve and is not able to pass back through the housing inlet said breathe-out valve allowing gas to pass into the housing through the housing inlet.

9. A warning device as described in claim 8 wherein the housing has an inlet chamber and an outlet chamber; and wherein a backing board is arranged in the housing to divide the housing into the inlet chamber and the outlet chamber, said backing board having a hole which allows gas to pass between the inlet chamber and outlet chamber, said battery, cell, acoustical signal means, and threshold switch located in the outlet chamber and attached to and supported in place by the backing board.

10. A warning device as described in claim 9 including an amplifier that is electrically connected between the cell and the threshold switch; and a battery monitor electrically connected to the battery to monitor the depletion of energy from the battery, said battery monitor and amplifier located in the outlet chamber and attached to the backing board.

11. A warning device for indicating the exhaustion of a separate gas filter retaining a toxic gas which device functions independently from the gas filter and comprises:

a housing having an inlet and an outlet through which gas is able to enter and leave the housing;

a gas filter fluidically connected to the housing inlet;

a full face mask fluidically connected to the housing outlet;

electrochemical means for directly detecting the overall concentration of the toxic gas that enters the housing, said electrochemical means disposed within the housing;

means for alerting disposed on the housing; and means for activating the alerting means when a predetermined concentration of toxic gas is detected, said activation means disposed within said housing.

12. A warning device as described in claim 1, wherein the housing is detachable to the gas filter and the full force mask.

* * * * *